US005355701A

United States Patent [19]

Tobias

[11] Patent Number: 5,355,701

[45] Date of Patent: Oct. 18, 1994

[54] METHOD AND APPARATUS FOR DECODING A PIN TUMBLER LOCK

[76] Inventor: Marc W. Tobias, 4317 Town Park Pl., Sioux Falls, S. Dak. 57105

[21] Appl. No.: 24,288

[22] Filed: Mar. 1, 1993

[51] Int. Cl.[5] ..... E05B 19/20

[52] U.S. Cl. ..... 70/394; 70/352; 70/405; 70/409; 70/413

[58] Field of Search ..... 70/394, 352, 339, 405, 70/413, 409; 33/539, 540

[56] References Cited

U.S. PATENT DOCUMENTS

| | | | |
|---|---|---|---|
| 2,066,645 | 1/1937 | Rial . | |
| 2,727,312 | 12/1955 | Tampke . | |
| 2,763,027 | 9/1956 | Tampke . | |
| 2,791,840 | 5/1957 | Harwell . | |
| 3,827,151 | 8/1974 | Naill | 70/394 X |
| 3,985,010 | 10/1976 | Idoni | 70/394 X |
| 3,987,654 | 10/1976 | Iaccino et al. | 70/394 X |
| 4,149,394 | 4/1979 | Sornes | 70/352 |
| 4,185,482 | 1/1980 | Nail | 70/394 |
| 4,517,746 | 5/1985 | Easley | 70/394 X |
| 4,535,546 | 8/1985 | Smith | 70/394 X |
| 4,667,494 | 5/1987 | Joosten | 70/394 |

FOREIGN PATENT DOCUMENTS

| | | | |
|---|---|---|---|
| 0100586 | 2/1984 | European Pat. Off. | 70/394 |

*Primary Examiner*—Lloyd A. Gall
*Attorney, Agent, or Firm*—Vickers, Daniels & Young

[57] ABSTRACT

Methods and apparatus for decoding pin tumbler locks, and more specifically, a mechanical key card lock. To determine the length and weight of a given pin tumbler, a probe is inserted within the lock, comprised of one or a matrix of many force sensing resistors. The probe will respond to variations in pressure and tension of each pin tumbler, and will thus provide a range of output resistances, directly related to the pressure exerted upon the sensor by a particular pin tumbler. The outputs of the sensors are then electronically sensed and recorded so that a duplicate key can be produced.

17 Claims, 7 Drawing Sheets

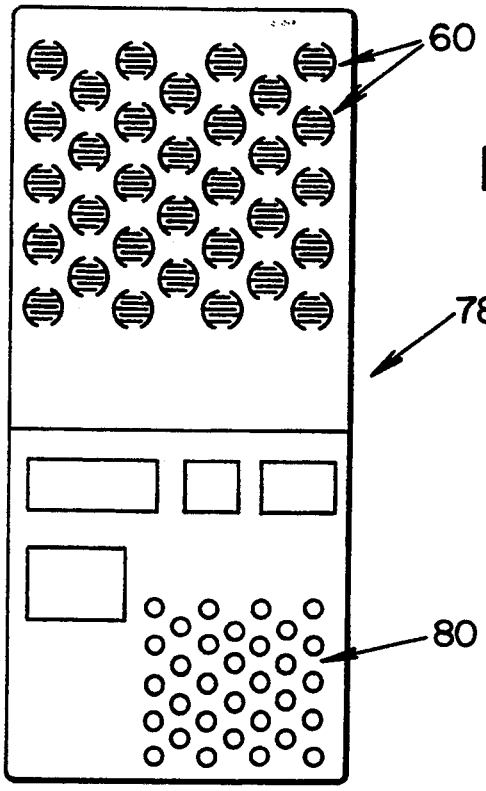
FIG. 7
FIG. 9
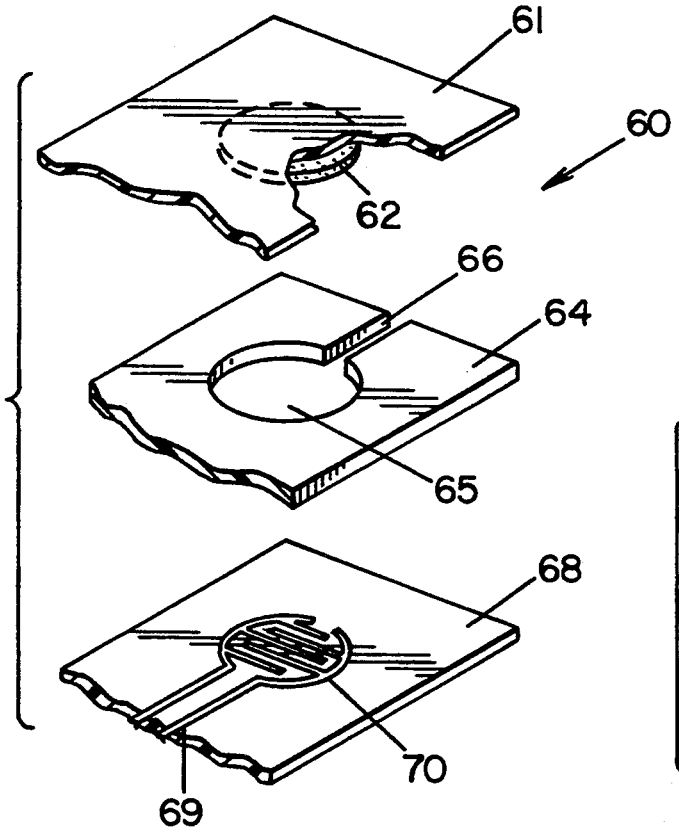
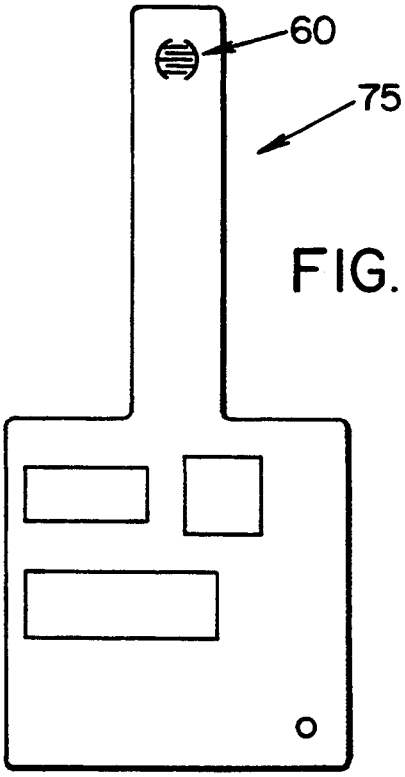
FIG. 8

FIG. 10
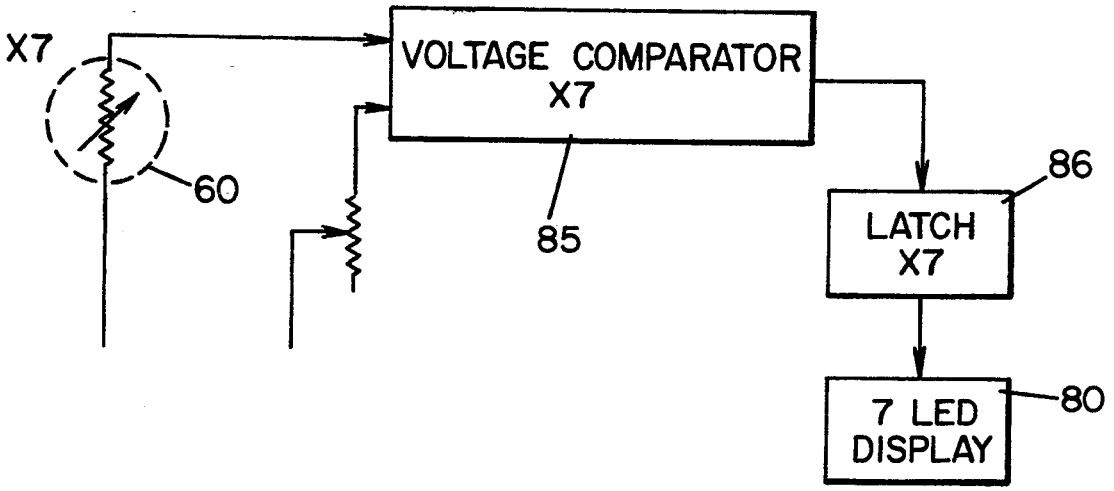
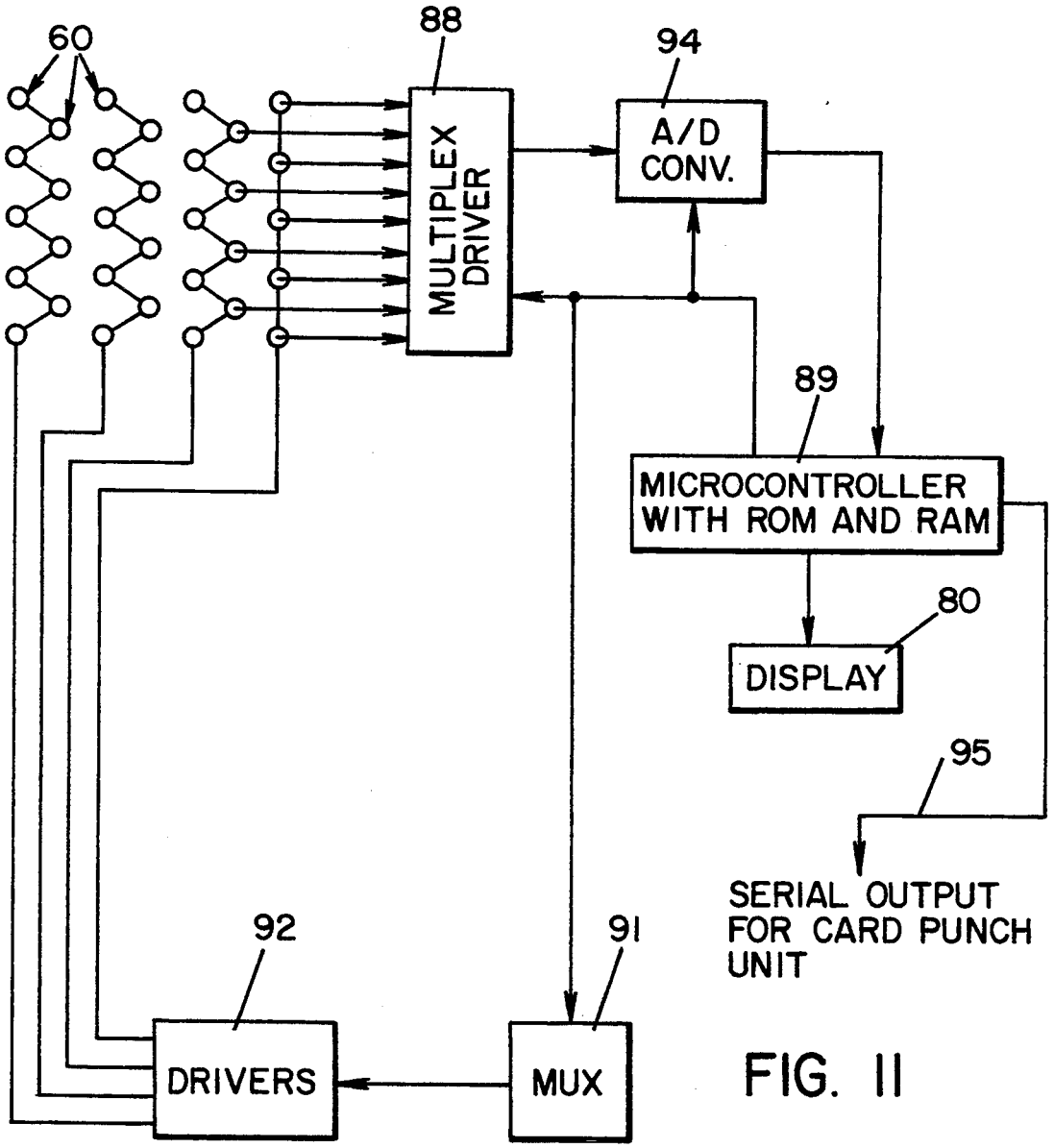
FIG. 11

METHOD AND APPARATUS FOR DECODING A PIN TUMBLER LOCK

This invention relates generally to locks and more particularly to a method and apparatus for decoding locks.

The invention is particularly applicable to and will be described with specific reference to a method and apparatus for decoding mechanical locks typically used in hotels and the like which are operated by plate-like key card members. However, the invention can have broader application and could be conceptually used to decode any mechanical pin tumbler lock.

INCORPORATION BY REFERENCE

The following patents are incorporated by reference so that the specifications hereof need not describe nor show in detail what is conventionally known and readily available to those skilled in the art.

| U.S. Pat. No. | Issued Date | Inventor |
|---|---|---|
| 2,066,645 | 1/5/37 | Rial |
| 2,727,312 | 12/20/55 | Tampke |
| 2,763,027 | 9/18/56 | Tampke |
| 2,791,840 | 5/14/57 | Harwell |
| 3,827,151 | 8/6/74 | Naill |
| 3,985,010 | 10/12/76 | Idoni |
| 3,987,654 | 10/26/76 | Iaccino |
| 4,149,394 | 4/17/79 | Sornes |
| 4,185,482 | 1/29/80 | Nail |
| 4,517,746 | 5/21/85 | Easley |
| 4,535,546 | 8/20/85 | Smith |
| 4,667,494 | 5/26/87 | Joosten |

BACKGROUND

As a result of a dramatic increase in litigation over the past ten years relating to issues of security, hotels have been forced to install specialized locking systems to insure security of guests and their property and to more accurately and securely control keys. Generally, the larger hotels have installed card locks or locks employing specialized keying systems, in order to restrict access to hotel rooms only to registered guests.

The major legal problem for a hotel is the loss of keys to rooms. Generally, a guest will fail to return a key upon checkout. In the old days, hotels would just make another duplicate of the original key, and periodically change the lock to each hotel room. Today, after many lawsuits, each and every time a guest does not return the key to his hotel room upon checkout, the combination of the lock is changed by all prudent hotel operators. Failure to insure that this standard is met may result in a hotel being found negligent.

There are several approaches to this problem. Winfield Locks, of Costa Mesa, Calif., manufactures a dual keyway cylinder, which allows for instant key change in the event of a lost key. These cylinders retrofit to existing lockset arrangements, and are quite popular. Another alternative is the use of magnetic stripe card locks, which can be reprogrammed instantly to lock out a guest card, and allow access to a newly verified card.

Yet another solution to this problem is the mechanical lock manufactured by TrioVing TM, model 1040, 1050, or 1060, to which the present invention specifically relates. Each of these locks is a mechanical pin tumbler system, operating with the use of a plastic key card. The card is inserted into the lock to allow actuation of the bolt. The key is actually a plastic card with one or more holes punched in any one or more of 32 possible positions in a predetermined matrix. This design affords millions of individual key combination possibilities.

The modern pin tumbler locking principle has been known for almost one hundred and fifty years. It relies upon the theory of double detainer action, which requires that one or more sets of pins be lifted precisely to the level of what is known in the art as a "shear line." This is the point where the tumblers are able to split, and allow rotation or other movement of a cam, plug, movable locking member, or a similar device. When all tumblers are precisely set at "shear line," then the lock can be opened.

A unique variation of the pin tumbler design was patented in 1979, by Sornes, of Norway, assigned to TrioVing a.s. The lock described in this patent, U.S. Pat. No. 4,194,394, utilized 32 pin tumblers, located in a predetermined pattern which form a matrix of holes contained within a horizontal plane measuring approximately 2"×1.75". When a plastic key card with the correct hole pattern is inserted into this lock, it will allow a horizontal movable locking member to be moved, to actuate an external bolt mechanism.

The design of these locks poses a problem for hotel staff and locksmiths in the case of a lockout problem. Unless an emergency bypass cylinder is operable, within the locking arrangement, there is no simple, rapid way to either open a lock, or produce a key for these locks. The lock can be extremely difficult to pick, using conventional methods. Thus, hotel staff, fire, police, emergency medical technicians, and locksmiths can find themselves in a position where they must destroy the lock, or the door supporting the lock, in order to gain entry to a hotel room. This can pose a threat to the safety of occupants of a hotel room, especially in the case of fire or a medical emergency, and particularly where the emergency bypass pin tumbler cylinder has not been installed, or is inoperable, due to mechanical failure or sabotage, or the emergency key is not readily available or has been lost. Generally, hotel room doors are constructed of heavy, solid wood, or metal and thus, the breaking and entering into a hotel room can be time consuming, and very costly. Such techniques are repugnant to professional locksmiths and hotel staff.

The VingCard TM system is extremely pick resistant to conventional methods of bypass. This means that it is difficult to insert a tool into the lock, and manipulate each tumbler, so as to cause that tumbler to break at shear line. The reader must understand, however, that there is a significant difference between picking the lock, and decoding the lock. This invention principally addresses the decoding of the lock.

Although many lock decoding devices have been patented, none have employed the concept of force sensing resistors, nor electronic means to decode the pressure of an individual pin within a pin tumbler lock. Many such decoders utilize feeler gauges, fine wires, or other similar devices in order to measure or determine the size and position of pin tumblers. All require a certain skill level to operate correctly, and will not provide a display of the data derived by use of the device.

Prior to the present invention, there has not been a decoding tool available which senses the pressure of pin tumblers, and specifically which would provide the required information from the TrioVing or similar locks regarding the placement and location of holes within the program code card, to allow rapid entry into the TrioVing lock, without inflicting heavy damage to the lock, door, door frame, and jamb.

SUMMARY OF THE INVENTION

Accordingly, it is a principle object of the invention to provide a method and/or apparatus for decoding a pin tumbler lock in an effective and/or efficient manner.

This object along with other features of the invention is achieved in a method for decoding a tumbler lock of the type in which a lock housing and a movable locking member, each, has a plurality of aligned bores arranged in a matrix, each bore containing a ball, first and second tumblers, and a spring mechanism biasing the tumblers towards one end of the bore. The lock housing further has a program card slot and a key card slot, and a permanent program card and a key card extending within the program card and key card slots, respectively, with each slot passing through each bore and the program and key cards cooperating with one another such that when the key card is inserted into its slot, the intersecting position of the first and second tumblers in each bore are coincident with the shear line of the lock to permit movement of the locking members. The method specifically comprises the steps of (i) inserting a tool into the key card slot; (ii) measuring, by the tool, at each bore position, the force exerted by the tumblers at the key slot; (iii) recording the force at each bore position as falling within either a first or a second force range and (iv) duplicating a key card by constructing a key card having an opening in each bore position in which the first force level was recorded and a closed position at each bore position where the second force level was recorded.

In accordance with another aspect of the invention, the bores are arranged in a matrix defined by a plurality of rows and a plurality of columns generally perpendicular to the rows and the tool is drawn sequentially across each bore to measure the force with which the tumblers within each bore exert on the tool and recording the force measured by the tool for each bore by identifying each bore force by its row and column position. In accordance with another aspect of the invention, the force levels of a plurality of bores within a specific row (or rows) are simultaneously and individually measured as the tool is drawn simultaneously across a plurality of bores in a specific row so that the tool need only be moved or drawn across a plurality of rows in the lock matrix. In accordance with a still more specific aspect of the invention, the tool is provided with a plurality of force measuring areas positioned in a matrix identical to the matrix utilized in the lock so that when the tool is inserted into the lock key slot, each individual bore has its force level simultaneously measured by the tool and recorded in its proper position within the matrix.

In accordance with another separate feature of the method aspect of the invention, the method includes the additional steps of providing first and second thin metal sheets with a strip of carbon or a carbon-type paper therebetween to define a sandwich assembly; inserting the sandwich assembly into the key slot and removing therefrom the lowermost metal strip; providing a thin U-shaped rake having a bight portion connecting leg portions of the rake and inserting the rake and specifically the bight portion of the rake into the key slot and pushing the bight portion of the rake to the innermost end of the key slot whereby the carbon paper has marks corresponding to the first force levels formed therein by the movement of the bight portion of the rake over the bore positions. In accordance with a still further aspect of the invention related to the carbon paper decoding process, a master key card is provided with a plurality of holes extending therethrough, the diameter of each hole corresponding to the diameter of each bore and all holes in the master key card are arranged in the same pattern as are the bores in the lock. A tape is placed over one side of the master key card to cover all the holes in the master key card and the carbon-type paper is overlaid onto the master key card with the marks formed in the carbon paper in registry with certain tape-covered holes in the master key cards. Openings are punched in the tape corresponding to the carbon paper marks whereby a duplicate key card suitable for opening the lock with the specific combination decoded therein is provided.

In accordance with still yet another aspect of the invention apparatus for decoding the lock is provided. The lock has a lock housing and a locking member supported in the housing for movement between a locked and unlocked position. The lock housing and the locking member each has a like plurality of bores arranged in an identical array or matrix of columns and rows which are adapted to be in and out of registry with one another. Each aligned bore in the housing and locking member has a ball, first and second tumblers and a spring biasing mechanism and further includes a key card slot and a program card slot. When an appropriately coded key card and a program card are inserted into the key card slot and program card slot, respectively, the key card and the program card have predetermined openings or closed spaces in registry or alignment with each bore to precisely position within each bore the first tumbler in the lock housing and the second tumbler in the locking member to permit the locking member to move along a shear line relative to the locking housing. The decoding apparatus specifically includes a decoding key card for insertion into the slot having a plurality of pressure-sensitive areas formed therein in an array at least equal in number to the bores in a row of the matrix in the lock. Each pressure sensitive area is equal to the area of each bore and pressure sensitive means associated with each pressure sensitive area is provided for sensing the force of the tumblers in the bore which the pressure sensitive areas overlie and a mechanism associated with the pressure sensitive means displays the force sensed by each pressure sensitive area whereby the lock can be decoded once the force for all the bores in the matrix has been sensed and displayed. In accordance with a still further aspect of the invention, a master metal plate is provided with the same external dimension as the key card and having a plurality of openings therethrough formed in a matrix equal to that of the total number of aligned bores in the lock. A magnetic material is used to fill any number of selected openings in the master metal plate whereby a duplicate key card is generated.

It is an object of the present invention to provide method and apparatus for decoding and opening TrioVing TM mechanical locks, and other locks incorporating a pin tumbler design, where the pressure of each pin tumbler is directly correlative to (and can thus be measured) the length and relative position of the pin tumbler with respect to its shear line.

It is another object of the present invention to provide an apparatus which can be inserted into the keyway of a TrioVing or other lock, and which includes a matrix of force sensing resistors, connected to an electronic circuit for comparing resistance values derived from each tumbler, and ultimately providing a display or other signal to indicate the location and relative pressure, tension, or length of each tumbler for decoding purposes.

It is another object of the present invention to allow the operator to measure and correlate on a simultaneous basis, the resistance and pressure of each tumbler in a lock to electrically reproduce the exact tumbler pattern within the lock and thus allow for the generation of the correct key for said lock.

Yet another object of the invention is to provide method and/or apparatus which can decode a pin tumbler lock and in the process thereof have one or more or any combination of the following advantages: (1) the lock does not have to be disassembled to be decoded; (2) the lock may be accurately decoded within seconds, essentially silently, and without fear of detection; (2) there are, in effect, only two pin tumbler "depths", in contrast to the usual four to ten depths in a standard cylinder; (4) the keyway is not restricted as with a standard cylinder, and thus, any piece of plastic, cardboard, or stiff paper may be utilized for production of a key, assuming the correct dimensions, thickness, and hole centers; (5) there is no real skill required in decoding or producing a key; (6) no special tools are required to generate a key.

Still another object of the present invention is to provide a decoding tool which requires no or little skill to operate, will store in memory the lock code for later use, and is silent. Still another aspect of the invention is to provide with or without the decoding tool, a key generator which is extremely small, requires no electricity (or alternatively no external source of electricity), is totally mechanical, and will produce a perfect key in less than one minute, depending upon the number of holes that are required.

Yet another object of the invention is to provide a simple and inexpensive decoding device for a pin tumbler lock.

These and other objects of the invention will become apparent to those skilled in the art upon reading and understanding the detailed description of the invention set forth below taken in conjunction with the drawings described below and which form a part of the invention hereof.

BRIEF DESCRIPTION OF THE DRAWINGS

FIG. 7 is a schematic, plan view of the preferred embodiment of the decoder tool of the present invention and is similar to FIG. 6;

FIG. 8 is a view similar to FIGS. 6 and 7 and shows an alternative embodiment of the decoding tool of the present invention;

FIG. 9 is a schematic, perspective view of the pressure-sensitive area used in the decoder tool shown in FIGS. 6, 7 and 8;

FIG. 10 is an electrical schematic or circuit which could be used in conjunction with the decoder tool illustrated in FIGS. 6 or 8;

FIG. 11 is an electrical schematic or conventional circuit which could be used with the decoder tool illustrated in FIG. 7;

DETAILED DESCRIPTION OF THE INVENTION

Figure 1:
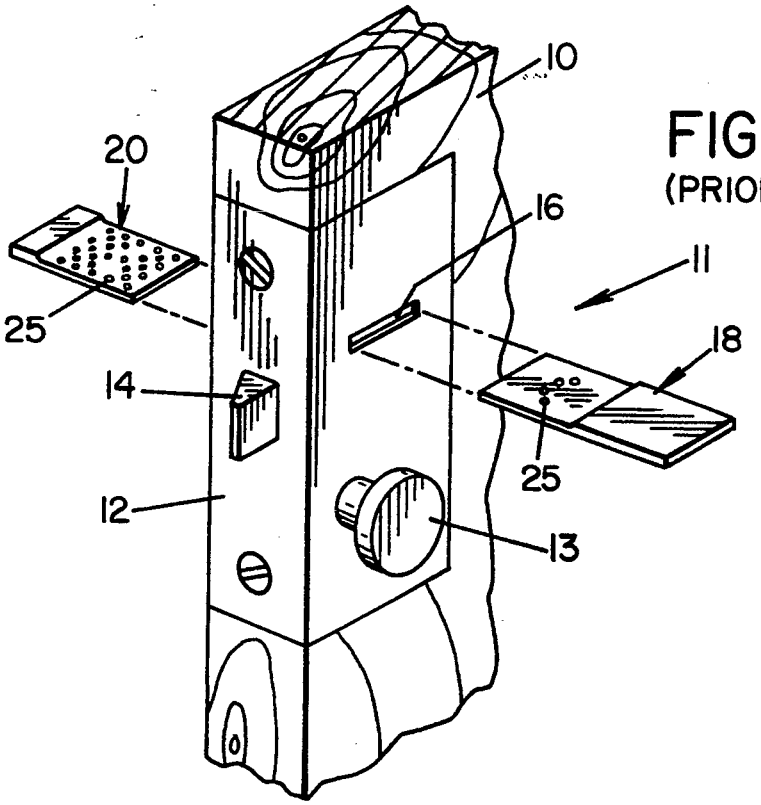
FIG. 1 (PRIOR ART)
FIG. 1 shows schematically and in perspective a section of a door with a lock, a key card, and a program card of a conventional lock and is similar to FIG. 1 of U.S. Pat. No. 4,149,394.
Figure 2:
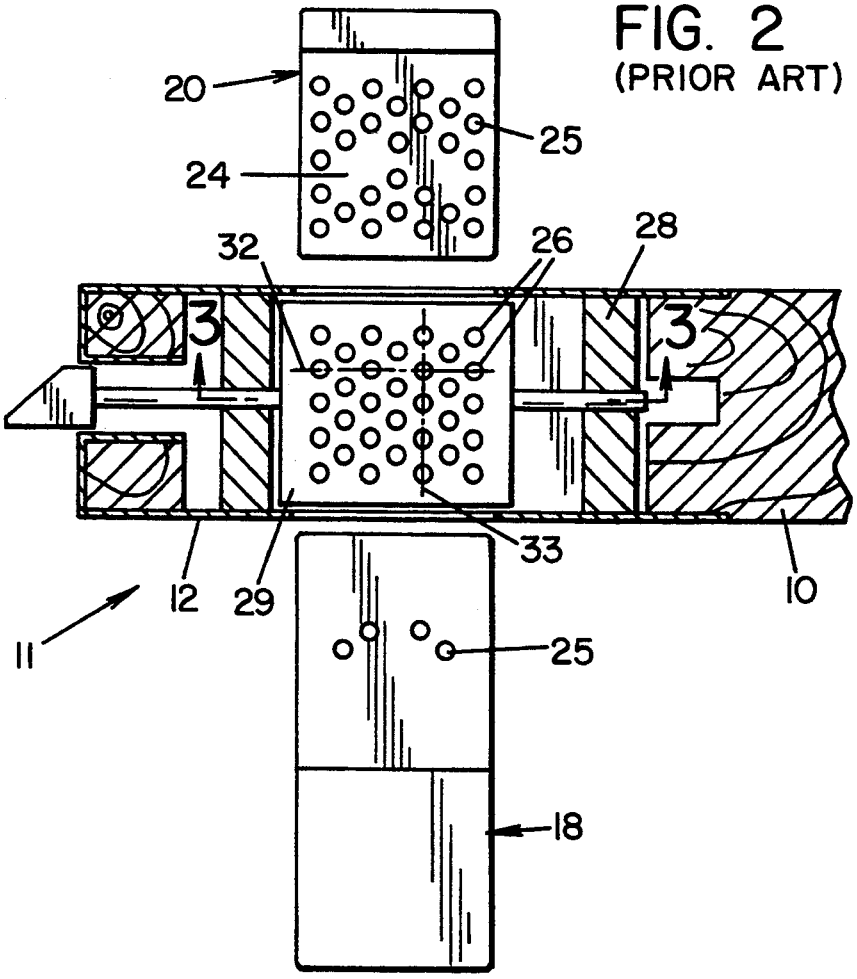
FIG. 2 (PRIOR ART)
FIG. 2 is a horizontal sectioned view through the door of FIG. 1 and is identical to that disclosed in FIG. 2 of U.S. Pat. No. 4,149,394.
Figure 3:
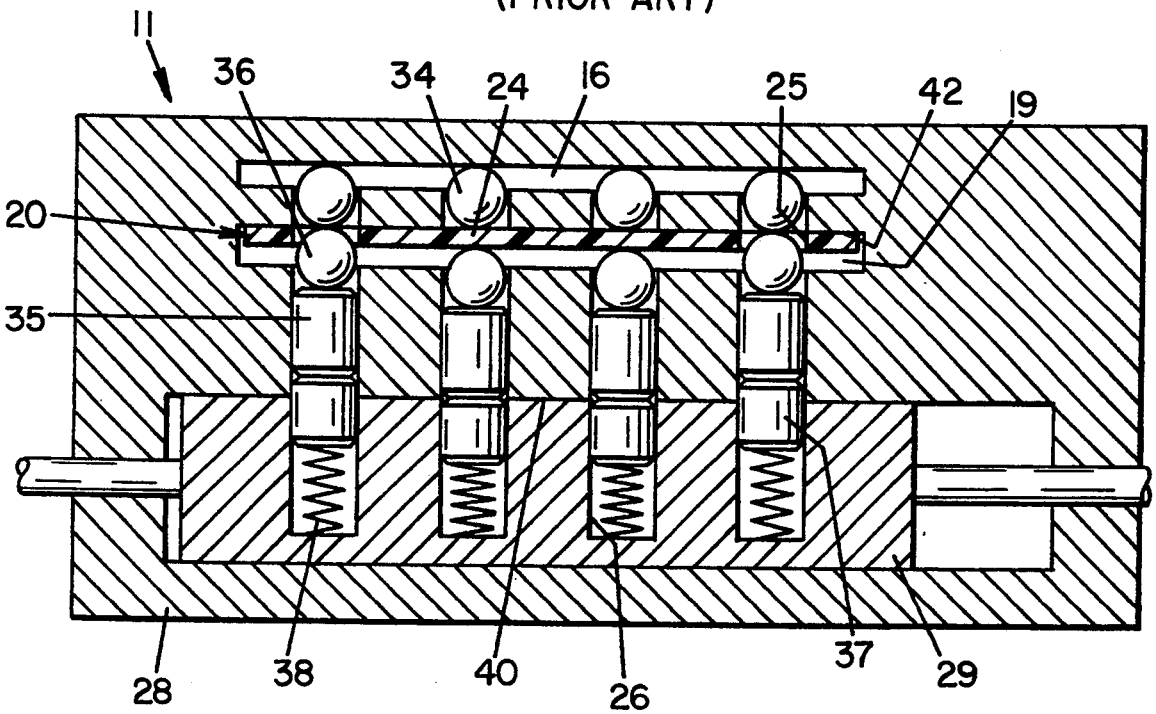
FIG. 3 (PRIOR ART)
FIG. 3 is a longitudinally-sectioned view taken along line 3—3 of FIG. 2 and is similar to FIG. 4 of U.S. Pat. No. 4,149,394.
Figure 5:
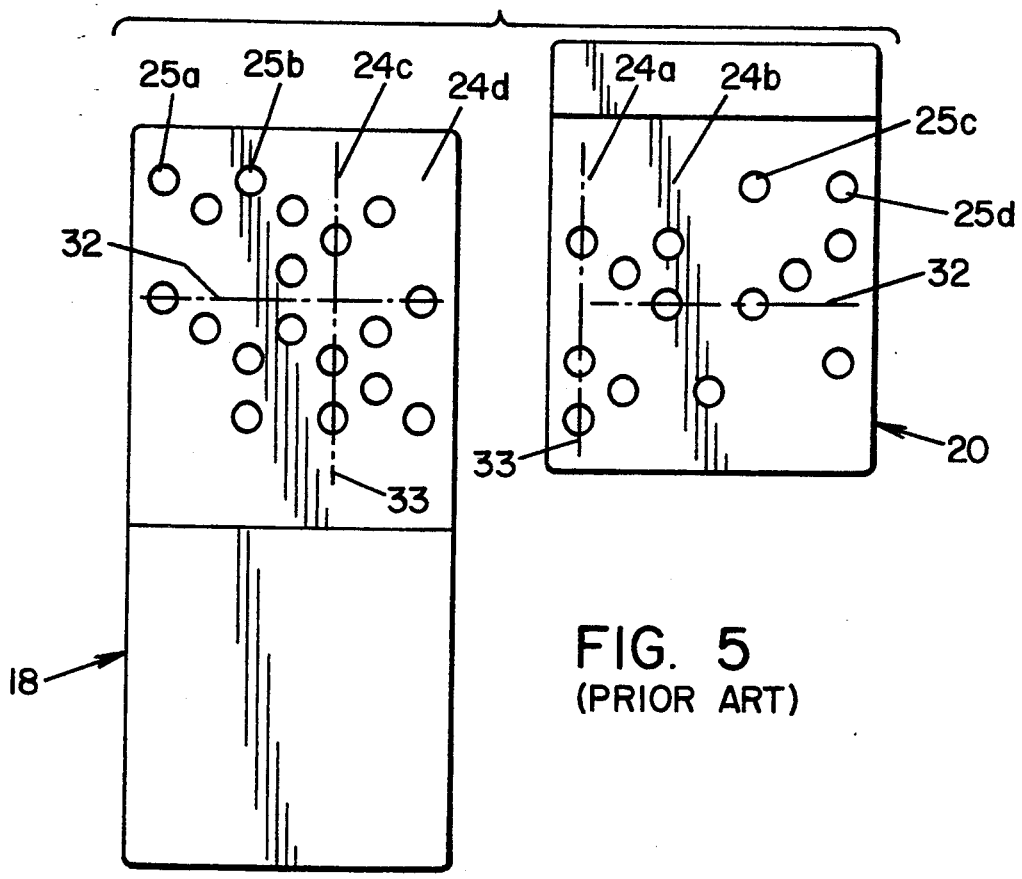
FIG. 5 (PRIOR ART)
FIG. 5 is a schematic view of the key card and program card of the prior art lock to which the invention relates.

Referring now to the drawings wherein the showings are for the purpose of illustrating preferred and alternative embodiments of the invention only and not for the purpose of limiting same, there is shown in FIG. 1 a door 10 having a lock box 12 with a door knob 13 and a latch bolt 14. Lock box 12 has a key slot 16 for receiving a key card 18, and on the opposite side of the door a program card 20 is also provided to be inserted into a program card slot 19 (not shown in FIG. 1). Lock box 12 shown in FIG. 1, as well as in FIGS. 2, 3 and 5 is conventional and is disclosed in U.S. Pat. No. 4,149,394 to Sornes. Reference is to be had to the Sornes' patent (hereinafter "Sornes") for a more definitive explanation of the workings of the lock shown in FIGS. 1, 2, 3 and 5 than that set forth herein. It must be remembered however that Sornes U.S. Pat. No. 4,149,394 does not accurately depict the commercial lock in use today. Specifically the '394 patent discloses two balls when only one ball for each bore is in use. Also, although a matrix of 32 holes is disclosed only 30 holes are actually used. The basic mode of operation is, of course, unchanged.

The following terminology will apply to the lock to which the present invention relates:

Program card 20. The program card 20 resembles an individual key card 18, and has a pattern of individual holes 25 within a predetermined matrix. Program card 20 is also inserted into lock 11, and determines the actual combination of lock 11, and the requirements of individual key card 18. The hole pattern of program card 20 will be complementary to that of individual key card 18.

Bore 26 Pattern. A matrix of 32 individual bores 26, consisting of seven rows of alternating numbers (4 or 5) of bores 26. (Those skilled in the art will recognize that the number of bores 26 and the bore pattern described is that utilized in the TrioVing system. The invention is obviously not limited to this particular matrix. In fact for ease of illustration, the hole pattern shown in the drawings comprises rows having 3 or 4 bores 26.) Tumblers are placed in each bore. Program card 20 determines the precise combination of the lock, utilizing all 32 tumbler positions.

Holes 25 within Program Card 20 and Individual Key card 18. A hole 25 refers to a punched position within program card 20 or individual key card 18, which will allow an upper tumbler 35 and/or steel ball 34 to protrude and travel through such holes 25 when key card 18 is inserted into lock 11.

Housing 28. The portion of lock 11 in which movable locking member 29 resides. Housing 28 corresponds to the shell in a conventional pin tumbler lock.

Individual Key card 18. Key card 18 is a plastic card, measuring 2"×1.75", which has a pattern of individual holes 25 which form the unique combination of a specific lock. This card is used by the guest to open the lock.

Lower Tumbler 37. The tumbler 37 making contact with the spring 38 in each hole position within the lock. This tumbler forms the lower half of the tumbler set which must be raised and split at shear line 40.

Movable Locking Member 29. This is the part of lock 11 that when the proper key card is inserted, causes actuation of bolt 14. It is equivalent to the rotating plug portion of a conventional pin tumbler lock.

Shear line 40. The split or gap between lock housing 28, and movable locking member 29. It is that point where there is a break between lower 37 and upper tumbler 35, which allows movable locking member 29 to be advanced.

Solid Space 24 within Code or Individual Key card. A solid space 24 refers to any position on either program card 20 or individual key card 18, where a hole 25 is not present for any specific tumbler position within the 32 pin hole matrix.

Tumbler Set. A tumbler set is comprised of a spring 38, lower tumbler 37 and upper tumbler 35, and at least one steel ball 34.

Upper Tumbler 35. This tumbler 35, in combination with lower tumbler 37, forms the tumbler set which is responsible for retaining movable locking member 29 in a locked position, until the proper key is inserted into the lock. Upper tumbler 35 must be forced downward to the correct position (shear line 40) before the lock can be opened.

It is to be appreciated by those skilled in the art, that while the actual position of the parts, specifically the pin tumblers 35, 37, 38, the movable lock member 29, lock housing 28 etc. is as shown, nevertheless in accordance with the broader aspects of the invention, the past positions are relative. Specifically, the tumbler configuration can change and the movable lock could rotate relative the housing, etc.

I.) System Overview

The Sornes lock system operates upon the principle that movable locking member 29 is restricted from moving within housing 28 from a locked to unlocked position by 30 or 32 sets of upper 35 and lower 37 pin tumblers, much the same as in a conventional pin tumbler lock. A program card 20 determines the precise pin tumbler combination for each lock, and provides the possibility for millions of different key combinations.

II.) Used in Hotel Locking Systems

The Sornes lock concept is extremely clever. Lock 11 is, in actuality, a 32 pin tumbler device, operating on a horizontal plane, rather than upon a rotating axis. The system utilizes plastic cards instead of the more conventional metal keys. Most of Sornes locks also contain conventional emergency key cylinders (not shown) to allow access by maintenance and maid staff. No master keying is available in the card portion of the Sornes lock.

Generally, the security department of a hotel is responsible for code programing card changes under the following conditions:

1. When a guest failed to return a key upon checkout;
2. When a guest reported that a key was lost or stolen;
3. When a key is reported broken or damaged.

The design of these locks poses a problem for hotel staff and locksmiths, in the case of a lockout problem. Unless an emergency bypass cylinder is operable, within the locking arrangement, there is no simple, rapid way to produce a key for these locks if a keycard cannot be located. The lock can be extremely difficult to pick, using conventional methods. Thus, hotel staff, fire, police, emergency medical technicians, and locksmiths can find themselves in a position where they must destroy the lock, or the door supporting the lock, in order to gain entry to a hotel room. This can pose a threat to the safety of occupants of a hotel room, especially in the case of fire or a medical emergency, and particularly where the emergency bypass pin tumbler cylinder has not been installed, or is inoperable, due to mechanical failure or sabotage, or the emergency key is not readily available or has been lost.

Generally, hotel room doors are constructed of heavy, solid wood, or metal, and thus, the breaking and entering into a hotel room can be time consuming and very costly. Such techniques are repugnant to professional locksmiths and hotel staff.

The methods and apparatus described herein will allow entry into any hotel room quickly and without damage.

III.) Theory of Operation

The Sornes lock system operates upon the principle that movable locking member 29 is restricted from moving within housing 28 from a locked to unlocked position by 30 or 32 sets of upper 35 and lower 37 pin tumblers, much the same as in a conventional pin tumbler lock. A program card 20 determines the precise pin tumbler combination for each lock, and provides the possibility for millions of different key combinations.

Once a program card 20 is inserted into lock 11, a corresponding individual key card 18 is required to actuate lock 11. The program card 20 and individual key card 18 have hole positions complementary to each other. The purpose of holes 25 punched in cards 18, 20 is to allow steel balls 34, 36 to be properly positioned within bores 26 and accordingly regulate the position of upper and lower tumblers 35 and 37. Where there is hole 25 in program card 20, there must be a corresponding solid space 24 in individual key card 18. Likewise, where there is solid space 24 in the program card 20, there must be a hole 25 in individual key card 18.

Each tumbler set is comprised of a spring 38, a lower tumbler 37, an upper tumbler 35, and one or two steel balls, 34, 36. Two steel balls are shown in the drawings. As noted above, the commercial system uses one ball. In that system lower ball 36 is deleted and upper tumbler 35 is reshaped to have an upper pointed end. The upper pointed end establishes a point contact between upper ball 34 and upper tumbler 35. Alternatively, lower ball 36 could be viewed as simply fused to upper tumbler 35.

There is a matrix comprised of 32 bores 26, arranged in seven rows, within both lock housing 28 and movable locking member 29. As noted above, for drawing clarity, the thirty-two bores 26 are shown arranged in nine rows 32 of four and three bores and also bores 26 arrayed in columns 33 perpendicular to rows 32 to produce a rectangular array. Other configurations are possible. In a locked position, all bores 26 are aligned or in registry with one another for both lock housing 28 and locking member 29 and contain lower and upper tumblers 35, 37. When the correct key card 18 is inserted, all of the tumblers are raised to shear line 40 which will allow movable locking member 29 to be slid forward, by pressure exerted upon the individual key card 18, as it is inserted into the lock.

As has been noted, each tumbler set is comprised of a lower 37 and upper 35 tumbler, and steel balls 34, 36. There are 30 or 32 such sets within each lock 11. The combination of holes 25 and solid spaces 24 within program card 20 will determine the relative position of each steel ball 34, 36 within each tumbler set.

In those locations where there is a solid space 24 on the code programming card, there will be a steel ball 34 trapped between program card 20 and key card slot 16 for individual key card 18. A great deal more tension is required to depress steel ball 34 resulting from solid space 24 in program card 20 than where a hole 25 is located within the program card 20. It is this design feature of the lock which allows it to be easily decoded.

IV.) Detailed Theory of Operation

The modern pin tumbler locking principle has been known for almost one hundred and fifty years. It relies upon the theory of double detainer action, which requires that one or more sets of pins be lifted precisely to the level of what is known in the art as a "shear line." This is the point where tumblers 35, 37 are able to split, and allow rotation or other movement of a cam, plug, movable locking member, or similar device. When all tumblers are precisely set at "shear line," 40, then the lock can be opened.

When a plastic key card 18 with the correct hole pattern is inserted into lock 11, it will allow horizontally movable locking member 29 to be moved to actuate an external bolt mechanism 14. Construction of lock 11 shown in the Sornes patent is straight forward, and resembles, in function, a traditional pin tumbler cylinder. However, in lock 11, shear line 40 is created on a horizontal plane between housing 28 and locking member 29 with movement of locking member 29 occurring in a forward or reverse horizontal direction, rather than the traditional rotating motion of a conventional pin tumbler lock.

The lock apparatus is comprised of housing 28 in which locking member 29 is movable between a locked and unlocked position and being equivalent to the plug and shell of a conventional pin tumbler lock. Housing 28 and locking member 29 have aligned bores 26 containing spring biased blocking pins or tumblers 35, 37 supported for movement between a first position in which locking member 29 is movable relative to housing 28 and a second position in which pins or tumblers 35, 37 block movement of locking member 29 relative to housing 28. The Sornes lock thus employs the same principle as a conventional pin tumbler lock.

A plate-like plastic individual key card 18 is inserted into key slot 16, and a plate-like plastic program card 20 is inserted into program slot 19 provided in housing 28. Bores 26 in housing 28 and locking member 29 are arranged in a predetermined pattern and the plate-like key card 18 and program card 20 have respective regions corresponding to the location of the bores in the pattern.

Movable locking member 29 will only be allowed to move in a forward direction through the application of forward pressure upon a correctly coded and inserted key card 18 which in turn will properly align all 32 pin tumblers at shear line 40. To set the unique pin combination, program card 20 is inserted into the rear of the lock body into program card slot 19 as shown in FIG. 3. Program card 20 will contain a unique pattern of holes 25. There will be one or more holes 25 present, within a matrix of 32 possible holes and locations, corresponding to bores 26 in housing 28 and movable member 29.

The key card 18 for lock 11, as shown in FIG. 5 will have a complementary pattern of holes 25 to that of program card 20. More specifically, for each specific hole, such as that shown as **25*c* in FIG. 5, in program card 20, there will be a corresponding solid space, such as that shown by 24*c* in FIG. 5, formed in key card 18. Likewise, for each specific solid space, such as that shown in 24*a* in FIG. 5, in program card 20, there will be a specific hole, such as that shown by 25*a*, in key card 18. Thus, if program and key card 18 are overlaid and superimposed upon one another, all 30 or 32 possible bores 26 would be represented and there will be for each bore 26, a hole 25 and a solid space 24**.

There is a spring biased pin tumbler set associated with each bore 26 within housing 28 of lock 11. Specifically, there is a spring 38, a lower tumbler 37, an upper tumbler 35 and one or two steel balls 34, 36. The function of lower 37 and upper 35 tumblers is to block movement of locking member 29 until all lower and upper tumblers are positioned so as to split at shear line 40, much the same as with a conventional pin tumbler lock.

The function of steel balls 34, 36 is to control the vertical positioning of program card 20 within program card slot 19. As described in the Sornes patent, program card 20 usually rests at an upper wall 42 of the slot 19. It is, however, free to move in a downwardly direction within program card slot 19, if depressed by any one or more of the 32 upper steel balls 34. If program card 20 has a hole 25 in a specified position, then the spring tension or pressure exerted upon the lower and upper tumblers 37, 35 and steel balls 34, 36 will be minimal, and equivalent to the actual force exerted by the expansion of spring 38. On the other hand, if there is a solid space 24 on program card 20 at the position of steel balls 34/36, then because of the precise location of program card slot 19, program card 20 will slide in between steel ball 36 and steel ball 34, resulting in upper steel ball 34 being positioned above solid space 24 on program card 20. When individual key card 18 is inserted in the lock at slot 16, then all upper steel balls 34 which are trapped above program card 20 must be allowed to protrude through corresponding holes 25 in the individual key card 18. Thus, for every solid space 24 on program card 20, there must be a corresponding hole in individual key card 18. Otherwise, in any location where there is not a corresponding hole in individual key card 18, upper steel ball 34 will force program card 20 downward because there is not enough clearance in program slot 19 to accommodate upper steel ball 34 without a corresponding hole 25 in individual key card 18. This changes the position of the break (i.e. the intersection of the two tumblers) between upper 35 and lower 37 tumblers, and causes locking member 29 to remain locked in position relative to lock housing 28 by action of one or more pin tumblers not breaking at the proper shear line 40.

In like manner, whenever there is a hole 25 in a particular position in program card 20, there must be a corresponding solid space on individual key card 18. This is so because the break between lower and upper tumblers 37, 35 is controlled by the position of steel balls 34, 36 and their contact with the bottom surface of individual key card 18. Thus, just as when upper steel ball 34 must be free to rest upon the upper surface of program card 20 when there is a solid space 24 in program card 20 at a particular tumbler location, so also, lower and upper tumbler pins 37, 35 and steel balls 34, 36 must be stopped from extending to the upper slot surface of key card slot 16 when there is a hole in program card 20 at the tumbler or bore 26 position. In this manner, the exact break between lower and upper tumbler at shear line 40 are controlled by the placement of a hole 25 or a solid space 24 in program card 20, and corresponding solid space 24 or hole 25 in the individual key card 18.

THE INVENTION

Methods of Decoding the Sornes Lock

In accordance with the present invention, there are three methods of decoding the Sornes and similar mechanical locks:

(1) mechanically feeling the status of each pin tumbler, or (2) utilizing carbon paper or aluminum foil to produce an exact image of the key, by mechanical means, or (3) electronically decoding the status of each tumbler.

I.) Mechanical Decoding Procedure

To mechanically decode lock 11 a tool is made of 0.020" or 0.032" round shim stock, and is bent either in an "L" shape or preferably in a "U" shape. In operation, the tool is inserted to the back of the lock, beginning at either the first row to the right, or left, again, depending upon personal preference. For each row that is decoded, the tool must be properly aligned, so that as it is withdrawn, it will properly detect each tumbler in the row. It is preferred to use the "U" shaped end of the tool for this purpose. If this end is used, the tool will automatically remain aligned by all of the steel balls within any row.

To decode the lock, the tool is slowly withdrawn across each tumbler position. Two different levels of resistance are felt as the decoding tool is moved within the lock. When the tool is moved across a tumbler corresponding to a hole in program card 20, very slight resistance will be felt. In contrast, when the tool is moved across a tumbler corresponding to a solid space 24 in program card 20, there will be a significant increase in the resistance encountered in withdrawing the tool. This will be a heavy resistance, almost to blocking the removal of the tool, rather than a light to imperceptible resistance to the lateral movement of the tool. The heavy resistance correlates to the increase in tension encountered in depressing each steel ball 34 which is trapped above program card 20. The tool is actually depressing the entire program card 20 downward, rather than just a single tumbler. In actual decoding, the tool is moved across each tumbler, in each row, as it is withdrawn from the lock. The hole matrix pattern is copied and used as the master template while decoding the lock. Those positions which correspond to high resistance are simply noted on the matrix. All marked positions will correspond to holes punched in the individual key card.

(It will be noted that the left and right first rows only have four holes each. Although the master hole matrix in fact shows five holes for these two rows, the middle hole is utilized in the TrioVing system for maintaining internal pressure on the code programing card, and thus, there is not an active tumbler in these two locations.)

While the lock can be decoded in this manner, a semi-skilled operator is required to carefully position and draw the tool to correlate the movement to the matrix. Apart from the skill required to manipulate the tool, time is required to manipulate the tool. The invention described further below overcomes such drawbacks.

II.) Decoding by Image Production with Carbon Paper

A direct image of the tumbler positions within the lock can be produced through the use of carbon paper or aluminum foil.

The materials required for this procedure are:

1. a piece of soft carbon paper, cut the size of a key card,
2. two strips of 0.005" brass, cut to the size of a key card,
3. a wire rake, utilizing 0.032" diameter wire,
4. a master tumbler matrix card,
5. scotch magic tape, and
6. a ball point pen or other sharp-pointed instrument.

Reproducing an exact image of the tumblers in the lock essentially involves the same procedure as outlined above, regarding the mechanical decoding of the lock. All of the same principles apply, with respect to relative tumbler pressures encountered. The difference in this procedure is that an exact image or picture of the actual key is the result, rather than just information as to tumbler position.

In general, the procedure or method followed is to insert a piece of soft carbon paper into the lock, guided by a thin brass overlay, to hold the carbon paper in place. (A thin brass shield is also utilized when inserting the carbon paper, so that marking of the carbon will not occur improperly when the carbon paper is initially inserted into the lock.) A fine wire rake is moved across the tumblers, against the carbon paper, causing definable marks to be placed on the carbon paper at every position where there is a space 24 in the program card 20 and resulting high pressure on the tumbler. What is actually happening is that the wire rake is removing carbon from the paper, as a result of the abrasion due to friction, occurring between the high pressure tumblers and the rake. When the rake is passed across the carbon paper, it is also moving across the tumblers. The low pressure tumblers, defined by a hole 25 in program card 20 will not mark the carbon paper. They do not exert enough force to cause removal of carbon from the surface of the paper. The resulting marks on the carbon paper will show an exact image of the tumbler pattern within the lock. The marks on the carbon paper are then translated to an actual key, through the use of a master matrix card.

A detailed procedure using carbon paper to image the lock is set forth as follows:

1. Cut a piece of soft carbon paper 50 to the precise size of a key, 1.75"×3.0." Soft carbon paper marks differently than carbon paper with a relatively hard finish and is preferred.

Figure 14:
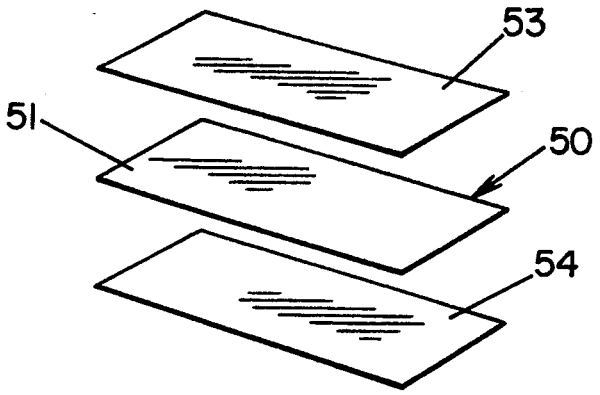
FIG. 14 is a schematic, plan view of a "sandwich" decoder tool used in an alternative method embodiment of the invention.

2. Cut two pieces of brass 53, 54 (1.75×3.0") to the same size as the carbon paper above. (FIG. 14)

Figure 15:
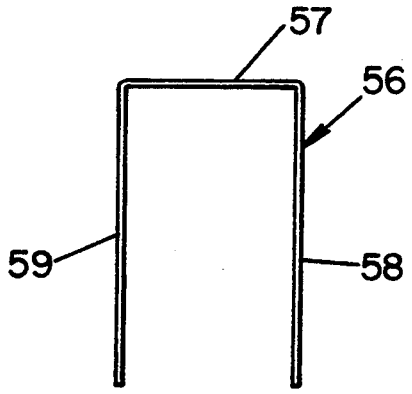
FIG. 15 is a plan view of the rake used in the alternative method embodiment of the invention.

3. Make a wire rake 56, as shown in FIG. 15, using shim stock, 0.032" diameter.

4. Attach a piece of carbon paper 50 to one of the pieces of brass, with a very small strip of scotch tape. The carbon side 51 of the paper must face toward the brass, and away from the tumblers.

Figure 16:
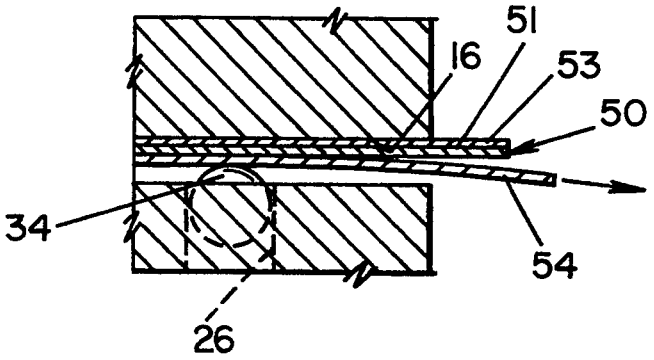
FIG. 16 is a longitudinally sectioned view of the lock showing the "sandwich" of FIG. 14 inserted into the key slot or keyway of the door.

5. Place another piece of brass 54, to act as a shield, on the other side of the carbon paper. Thus, a three layer sandwich is formed, comprised of brass 53, carbon paper 50, and brass 54. See FIGS. 14 and 16.

6. Insert the "sandwich" into the lock, until stopped by an end of housing 28. Then remove the unattached brass shield 54, which forms the bottom of the "sandwich." The purpose of this shield is to keep the tumblers from marking the carbon paper as the sandwich is inserted in the lock.

Figure 17:
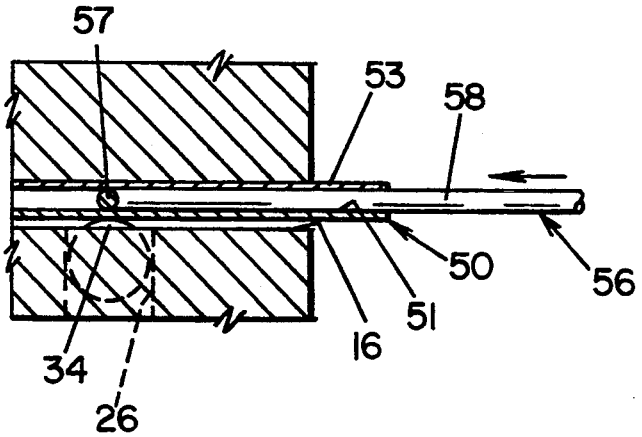
FIG. 17 is a view similar to FIG. 16 but showing the rake of FIG. 15 inserted into the door's keyslot.

7. Between the carbon paper 50 and remaining brass guide 53, insert wire rake 56, as shown in FIG. 17. Rake 56 is shown as being "U" shaped and has a bight portion 57 connecting its leg or end portions 58, 59. This must be done in a very specific manner to be effective.

a. Grasp rake ends 58, 59 with both hands, so that it can be guided straight into the lock without creating an angle. Thus, the bight portion 57 of rake 56 must always run parallel with the back of the housing, just as the key inserts into the lock in a straight line.

b. Apply downward pressure, using both hands, to the end of the rake, so that rake 56 exerts some force on the tops of the tumblers, as it travels through the lock.

c. Insert the wire slowly, being certain to apply pressure to each tumble as the rake passes over the pins.

d. Count the number of tumbler rows 32 that have been raked. There should be a total of nine of them. Then rake 56 will be stopped by the rear of the lock housing.

8. Withdraw rake 56 from the lock, while applying downward pressure.

9. Withdraw the brass/carbon paper "sandwich" from the lock.

10. Visually inspect the carbon paper for marking. Each mark will correspond with a hole 25 in key card 16.

11. Take a master hole matrix card, i.e. a card with a plurality of holes 25 corresponding to each bore 26 in the lock, and cover the bottom side with Scotch Magic Tape ©, one layer.

12. Take the end of a ball point pen or other sharp instrument, and pierce a hole in the tape, on the master matrix card, for every mark that appears on carbon paper 50. Be certain that the carbon is facing the operator when the procedure is performed, so that the image is not reversed. When selectively pierced, the master matrix card becomes a duplicate key card 18.

III.) Decoding by the Electronic Decoder

The present invention utilizes an array of force sensing resistors to detect and display the difference in pressure measured for each tumbler set. One force sensing resistor 60 is illustrated in FIG. 9. Force sensing resistor 60 is a polymer thick film device which exhibits a decrease in resistance with an increase in the force applied to the active surface. It is not a load cell or a strain gauge although it has similar properties. It is not suitable for precision measurements, but is ideally suited for the force resistance "on-off" type measurements required in the present invention. The force sensing resistor is commercially available from Interlink Electronics, a California concern.

As shown in FIG. 9, force sensing resistor 60 comprises three layers of materials, and specifically includes a flexible substrate 61 with a printed semiconductor 62 under which is secured a spacer adhesive 64 which has a spacer opening 65 and a vent 66, and under which, in turn, is secured a flexible substrate 68 with printed interdigitating electrodes. Electrode substrate 68 has a tail 69 for electrical leads and an active area 70 corresponding to the diameter of steel balls 34, 36.

It should now be appreciated that a decoder having the same length and width as key card 18, with a thickness of approximately 0.005–0.010", can be constructed with various arrays of force sensing resistors 60 imbedded thereon. A decoder 75, with one force sensing resistor 60 is illustrated in FIG. 8. Although decoder 75 could be used to decode a lock of the Sornes type, decoder 75 shown in FIG. 8 is provided for use in decoding conventional tumbler pin locks in which there may be more than simply an "on-off" sensing of the tumbler force. That is, the force sensed in a conventional pin tumbler lock can vary depending on the position of the tumbler, which in turn is correlated to the height or depth of the ridges formed in the key at the tumbler position. Accordingly, decoder 75 would sense a force level at each tumbler position which, in turn, would correlate to a key configuration at that tumbler position.

Figure 6:
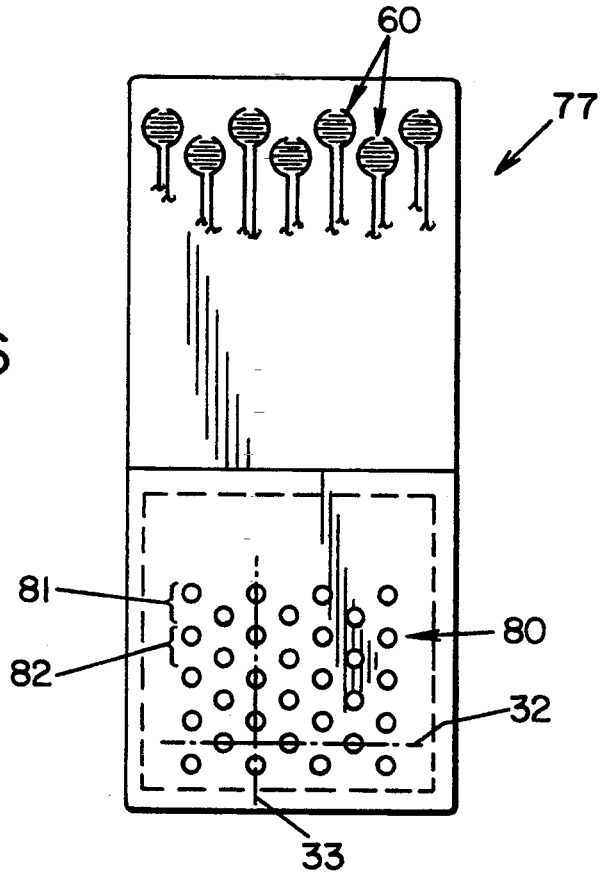
FIG. 6 is a schematic plan view of the decoder tool of the present invention.

In FIG. 6 there is shown a two row decoder 77 with two rows of force sensing resistors 60, and in FIG. 7 there is shown a multi-row decoder 78 having an array of force sensing resistors 60 equal in number to that used in the Sornes lock 11. Decoders 77 (FIG. 6) and 78 (FIG. 7) are specifically intended for use with the Sornes-type lock 11.

Figure 4:
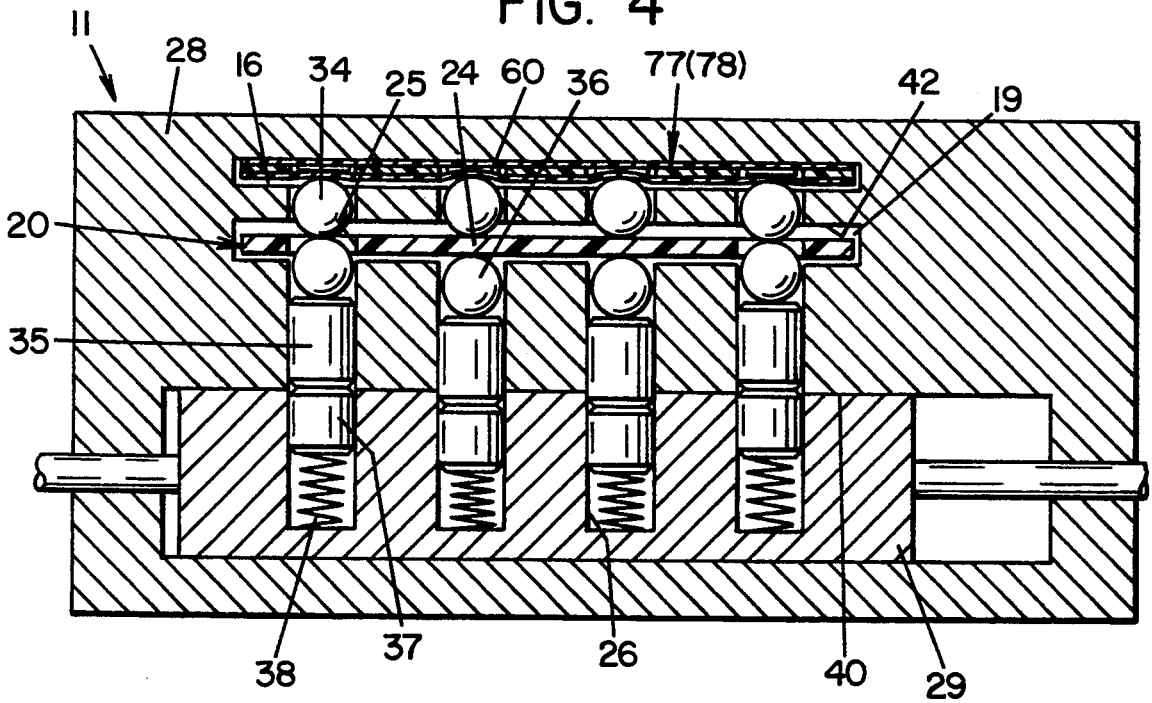
FIG. 4 is a view similar to FIG. 3 but showing the decoder tool of the present invention inserted into the key card slot.

As best shown in FIG. 4, two row decoder 77, or multi-row decoder 78 has a very thin thickness, with the same width and length dimensions as key card 18 and also the same width and length dimensions so that when decoder 77 or 78 is inserted into keyslot 16 and pushed into the slot to extend all the way to the stop at the back of the slot, steel balls 34 will be contacted by decoder 77 or 78. Where there is a solid space 24 in program card 20, steel ball 34 will depress force sensing detector 60 which in turn will create an electrical resistance thereat. Accordingly, a printed circuit board can be easily fabricated with leads connected to each force sensing resistor and appropriate conventional electrical circuitry, within the skill of any artisan, can be developed to display, store and/or recall the force experienced by each force-sensing resistor 60 corresponding to each bore 26 in lock 11 and from which an appropriate new key card 18 can be fabricated. In decoders 77 or 78 an LED arrangement 80 is used to indicate where hole openings 25 and solid spaces 24 should be formed in the new key card to be generated in accordance with the lighted LED display 80. As indicated, any conventional circuitry can be utilized to accomplish this function.

Electric circuitry schematically illustrated in FIG. 10 can be used for two-row decoder 77 shown in FIG. 6. In operation of two-row decoder 77, decoder 77 is moved into key slot 16. In this position force sensing resistors 60 in two-row decoder 77 will be in an array which will correlate to the first two rows 81 of bores 26 in lock 11. For the embodiment disclosed in FIG. 6, the first two rows will total seven bores 26, so that seven force sensing resistors 60 will be utilized. Voltage applied across force sensing resistors 60 will in turn produce a voltage drop. The amount of the voltage drop can be correlated to those force sensing resistors 60 which have been depressed by steel balls (i.e. solid space 24 in program card 20) or alternatively which have only developed a slight force (i.e. hole 25 in program card 20). In either event, the voltage level sensed can be stored or displayed for key card 18 duplication. In FIG. 6, the seven voltages sensed will be serially outputted to adjustable voltage comparator circuit designated as 85 in FIG. 10. This material will be stored into a latch circuit 86 which by actuation of a switch, etc. will in turn light those light emitting diodes in row 81 in which force sensing resistors 60 sense an appreciable force i.e., one higher than that exerted by tumbler spring 38 (or alternatively in which force sensing resistors 60 do not sense an appreciable force). Two-row decoder 77 is then retracted out of the key slot 16 a distance equal to the spacing of the first two rows of bores 26. Two-row decoder 77 will then sense the next two-rows of bores 26 designated by reference numeral 82 in FIG. 6, and the process continued until all rows containing bores 26 have had the pressure exerted by balls 34 sensed.

The more expensive one-step decoder 78 is shown in FIG. 7 and circuitry which might be used with one-step decoder 78 is shown in FIG. 11. In one-step decoder 78, force sensing resistors 60 equal in number to the number of bores 26 in lock 11 (30 or 32 in number for the embodiment under discussion) are positioned in an array identical to that used in bores 26 of lock 11. Appropriate circuitry is used to light LEDs 80 which will be configured in the bore matrix in one step. Conceptually, the wiring diagram for multi-row detector 78 could simply be comprised of nothing more than outputting the leads of each force sensing resistor 60 directly onto an associated LED which would require a certain voltage before it would light. Thus, certain LEDs would light and others would not to indicate the desired key card hole pattern. A more sophisticated arrangement is conceptually illustrated in FIG. 11 and includes a multiplex driver 88 under the control of a microprocessor 89 timing a pulsing circuit 91 which in turn actuates individual drivers 92 in sync with multiplex driver circuit 88 to develop an analog signal string. The analog string is digitized at 94 and stored in microprocessor 89. Microprocessor 89 can output the stored data to the light emitting diode display 80 or alternatively the digitized data can be outputted as at 95 to a conventional key card machine (not shown) available from the assignor of the Sornes patent which will generate the key card 18 which will open lock 11 sensed by multi-row decoder 78.

Figure 12:
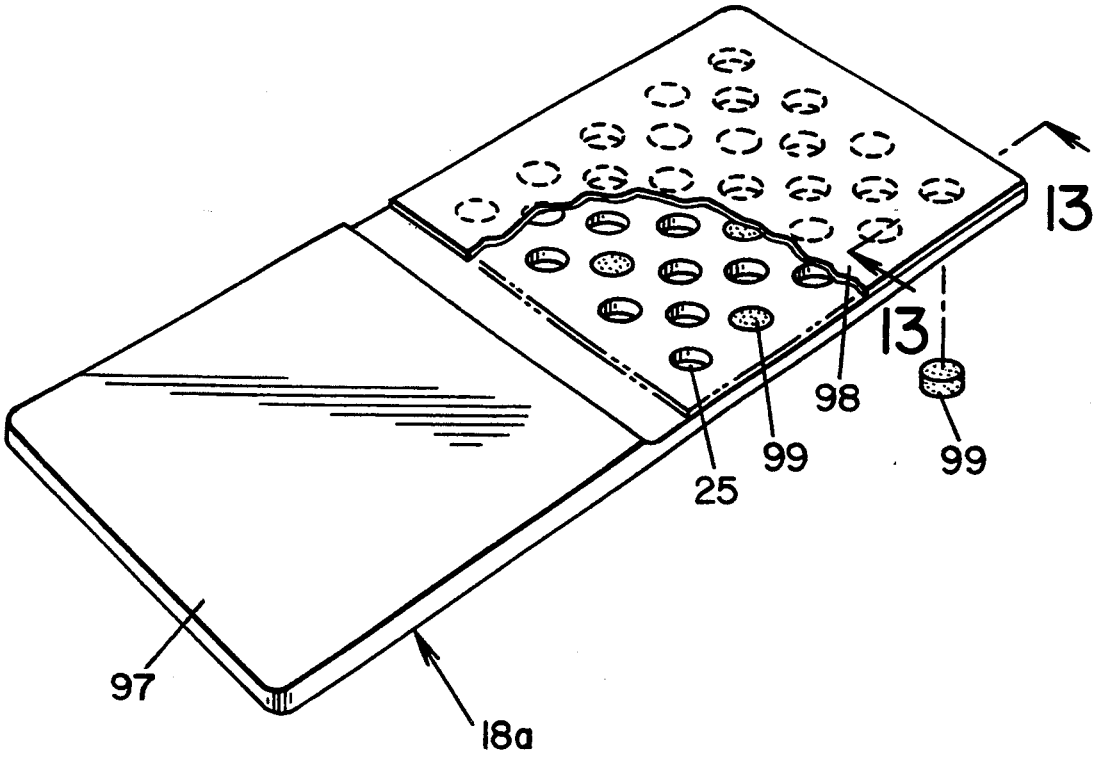
FIG. 12 is a schematic perspective view of a duplicate key card.
Figure 13:
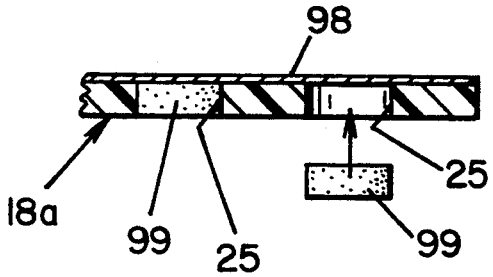
FIG. 13 is a sectioned view of the duplicate key card shown in FIG. 12 taken along lines 13—13 of FIG. 12.

Alternatively, FIGS. 12 and 13 show construction of a substitute key card **18*a* using the information obtained from decoder 77 or 78. The substitute key card 18*a* shown in FIGS. 12 and 13 has the precise length, width and thickness of a standard key card 18. Key card 18*a* has all holes 25 corresponding in number and position as that of bores 26 in lock 11. The top side 97 of key card 18*a* which does not come into contact with balls 34 within lock 11, will have a very thin piece of magnetic material 98 completely covering the card. This can be magnetized metal. Now reading the output of light emitting diodes 80 decoder 77 or 78, and from the underside of the card, magnetized barium ferrite vinyl plugs 99 having the same diameter as holes 25 and having the same thickness as that of key card 18*a* are used to plug the openings in substitute key card 18*a* where a solid spot 24 is to be produced. The magnetized plugs 99 are held in holes 25 by magnetic material 98. Note that the reverse is shown for the carbon paper embodiment of FIGS. 14 through 17. In FIGS. 14–17, all holes 25 were covered by a transparent tape which would be on the underside (not the top side) of card 18*a* and which would be punctured to permit selected balls 34** to pass therethrough.

The invention has been described with reference to a preferred embodiment and alternatives thereof. Modifications and alterations will appear to those skilled in the art upon reading and understanding my invention. Specifically, electronic circuitry other than that disclosed herein will readily suggest itself to those skilled in the art. Further, additional locating and guide structure can be employed with the decoding tools such as shown in FIG. 8 which can be used to decode conventional pin tumbler locks. The additional guiding and locating structure will be dependent upon the particular lock tumbler to be decoded and will suggest itself to those skilled in the art. It is intended to include all such modifications and alterations in so far as they come within the scope of the present invention.

Having thus defined the invention it is claimed:

1. A method for decoding a tumbler lock having a lock housing and a moveable locking member, said lock housing and said locking member, each, having a like plurality of aligned bores arranged in a matrix, each bore containing a ball, first and second tumblers, and a spring mechanism biasing said tumblers towards one end of said bore; said lock housing further having a program card slot and key card slot, and a permanent program card and a key card extending within said program card and key card slots; respectively, each slot passing through each bore and said program and key card co-operating with one another such that when said key card is mounted into its slot, an intersecting position of said first and second tumblers in each bore is coincident with a shear line of said lock to permit movement of said locking member; the method comprising the steps of:

a) inserting a tool in said key card slot;
b) measuring at each bore position by said tool the force exerted by said tumblers at said key card slot;
c) recording the measured force at each bore as falling within a first or second force level and
d) duplicating said key card by constructing a substitute key card having an opening at each bore position in which said first force level was recorded and a closed position whereat said second force level was recorded.

2. The method of claim 1 wherein said matrix includes said bores arranged in a plurality of rows and a plurality of columns generally perpendicular to said rows; and drawing said tool across each bore to measure the force which said tumblers within said bore exerts on said tool and recording the force measured by said tool for each bore by identifying each measured bore force by its row and column position in said matrix.

3. The method of claim 2 whereas said tool functions as a gauge to be positioned at a first row of bores, drawing said tool sequentially across all bores in a column associated with said row and then indexing said tool to the next row whereat the tumbler forces for the bores in the column associated with said next row is measured.

4. The method of claim 1 wherein said bores are arranged in a plurality of rows and columns, positioning said tool in said key card slot to extend within all the bores in several rows and to sense, for each bore, the force of said tumblers therein; recording the individual force of each bore within said first several rows, and then moving said tool out of said first several rows of bores into several additional rows of said bores and sensing the forces of each bore in said several additional rows and recording same whereat said tool is again positioned to extend within still additional rows until all bores have been sensed.

5. The method of claim 1 wherein said method includes said bores being arranged in a plurality of rows and columns, said tool having a plurality of force sensitized areas corresponding in number and position to an array identical to said matrix, positioning said tool in said key card slot so that said tool's array of force sensitized areas overlie said bores in said matrix to produce for each bore a force reading correlating to tumbler force at the key card slot for each bore and recording same.

6. The method of claim 1 wherein said force measuring step further includes:

a) providing first and second thin metal sheets with a strip of carbon or carbon-type paper therebetween to define a sandwich assembly;

b) inserting said sandwich assembly into said key card slot and then removing the lowermost metal sheet from said key card slot;

c) providing a thin U-shaped rake having a bight portion connecting the leg portions of said rake;

d) inserting said rake and specifically said bight portion of said rake into said key card slot between said carbon or carbon-type paper and said uppermost metal sheet and pushing said bight portion of said rake to the innermost end of said key card slot whereby said carbon or carbon-type paper has marks corresponding to said first tumbler force levels formed thereon.

7. The method of claim 6 further including providing a master key card with a plurality of holes, the diameter, number and orientation of said master key card holes identical to that of said bores in said lock; placing a tape over one side of said master key card to cover all holes in said master key card; overlaying said carbon or carbon-type paper on said master key card with said marks formed on said carbon or carbon-type paper in registry with certain tape-covered holes in said master key card; and punching openings in said tape corresponding to marks formed on said carbon or carbon-type paper whereby a duplicate or substitute key card is formed.

8. Apparatus for decoding a lock having a lock housing, a locking member supported in said housing for movement between a locked and unlocked position; said lock housing and said locking member, each, having a like plurality of bores arranged in an array of columns and rows and any given bore in said lock housing adapted to be in and out of registry with a related bore in said locking member depending on the position of said locking member; each aligned bore in said housing and in said locking member having a ball, first and second tumblers and spring biasing means urging said tumblers to one end of said bore; a key card slot and a program card slot within said lock housing and extending through each bore and a key card and a program card in each's respective slot, said key card and said program card having a predetermined opening or closed space in alignment with each bore to position within each bore said first tumbler in said lock housing and said second tumbler in said locking member to permit said locking member to move along a shear line relative to said lock housing, said apparatus comprising:

a decoding key card for insertion into said key card slot and having a plurality of pressure sensitive areas formed therein in an array at least equal in number to a row of said bores in a matrix, each pressure sensitive area equal to the area of each bore, pressure sensitive means associated with each pressure sensitive area for sensing the force of said tumblers in the bore which the pressure sensitive area overlies, and means associated with said pressure sensitive means for physically displaying the force sensed by each pressure sensitive area whereby said lock can be decoded once the force for all bores have been sensed and displayed.

9. Decoding apparatus of claim 8, wherein said pressure sensitive areas are equal in number to the number of said aligned bores in said lock.

10. Decoding apparatus of claim 9 further including a metal plate having the same external dimensions as said key card and filling means including magnetic deformable material for filling any number of selected openings in said metal plate whereby a duplicate key card is generated.

11. Lock decoding apparatus for use in a lock having a housing, a locking member supported in said housing for movement between locked and unlocked positions, said housing and said locking member having aligned bores, tumbler means supported in each of said aligned bores for movement between a first position in which the locking member is movable relative to the housing and a second position in which the tumbler means blocks movement of the locking member relative to the housing, a plate-like key card member, a plate-like program card member, said housing being provided with two slots each for respectively receiving one of said plate-like card members, said bores in the housing and locking member being arranged in a pre-determined pattern, said plate-like card members having respective regions corresponding to the location of said bores in said pattern, said plate-like card members when inserted in said slots positioning said regions in superimposed relation with one another for cooperating with said tumbler means, the thickness of the plate-like members in said regions being correlated in a code such that the combined thickness of said plate-like members in the superimposed regions is different from the combined thickness of said plate-like members outside the superimposed regions to constitute means for acting on said tumbler means to mechanically move the same to said first position when said code corresponds to the pattern of the bores, said decoding apparatus comprising:

an especially constructed plate-like member having a plurality of pressure sensitive areas formed therein, said plurality of pressure sensitive areas corresponding in number, size, and location to be identical to said bores in said lock, microprocessor means for determining the pressures sensed by each pressure sensitive area and generating a force signal indicative of the forces generated by said tumbler means and LED means for generating for each pressure sensitive area a lighted signal when the force signal for such pressure sensitive area exceeds a predetermined value.

12. Lock decoding apparatus as claimed in claim 11 wherein the combined thickness of the plate-like card members in the superimposed regions is half the combined thickness of the plate-like members outside said regions.

13. Lock decoding apparatus as claimed in claim 11 wherein one of said plate-like card members has holes in some of said regions and the other plate-like member has holes in the remainder of said regions such that when the cards are superimposed in each of said regions there will be only one hole in one of the card members.

14. Lock decoding apparatus as claimed in claim 11 wherein said tumbler means comprises a plurality of elements in each bore, at least one element being positioned to be engaged by the key card member and the program card member.

15. Lock decoding apparatus as claimed in claim 14 wherein said key card member and program card member engage said one element at opposite sides thereof.

16. Lock decoding apparatus as claimed in claim 14 wherein said one element is a ball.

17. Lock decoding apparatus as claimed in claim 15 wherein said elements of said tumbler means in each bore include pin elements and ball elements, said plate-like card members cooperating with said ball elements to displace said pin elements, said pin elements having a junction surface which is aligned with a mating surface between the housing and locking member in said first position of the tumbler means.

* * * * *